United States Patent [19]

Degenhart

[11] 3,961,856

[45] June 8, 1976

[54] SOIL COMPACTING MACHINE

[76] Inventor: Ernest Degenhart, Urbanizacion Bustamante No. 2, Avenue Espana, San Salvador, El Salvador

[22] Filed: Feb. 20, 1975

[21] Appl. No.: 551,376

[52] U.S. Cl. ..... 404/133; 74/48; 299/37

[51] Int. Cl.[2] ..... E01C 19/34

[58] Field of Search ..... 404/133, 124, 117; 74/48; 299/37

[56] References Cited

UNITED STATES PATENTS

| | | | |
|---|---|---|---|
| 1,431,364 | 10/1922 | Bradley | 404/133 X |
| 1,745,100 | 1/1930 | Johnston | 404/133 X |
| 2,084,983 | 6/1937 | Baily | 404/133 |
| 2,753,771 | 7/1956 | Brown | 404/133 |
| 2,908,206 | 10/1959 | Melanson | 404/133 |
| 3,472,135 | 10/1969 | Nevitt | 404/133 |

*Primary Examiner*—Nile C. Byers

*Attorney, Agent, or Firm*—Watson, Cole, Grindle & Watson

[57] ABSTRACT

A machine for compacting soil includes a plurality of compacting elements or hammers elevated and lowered by means of a rotary shaft having an arm member for each hammer extending through aligned hammer openings, each arm member being mounted on the shaft eccentrically with respect to the hammer openings and at different radial positions along the shaft. For elongated hammers limiting rollers may be located at opposite side edges thereof and means are provided for rotating the shaft to effect a walking movement of the machine in a forward direction so that, upon such rotation, the hammers are moved successively upwardly as the arm members rotate between a forward horizontal position and an upward vertical position. The hammers are permitted to be moved successively downwardly into contact with the soil as the arm members each rotate beyond their rearward horizontal positions in the case of forward movement of the machine. Each hammer remains in shifting contact with the soil during rotation of its arm member between the rearward or forward horizontal position and the forward or rearward horizontal position thereof. The hammers effect a kneading action against the soil as they successively make contact therewith thereby expelling the air from the soil and effecting a rearrangement of the soil crystals for improving upon the compaction of the soil surface. Moreover, the extent of the shifting movement of each elongated hammer can be varied as one end of the limiting roller supports is moved toward or away from the shaft to thereby effect a turning movement for the machine. By moving both ends of the limiting roller supports to or away from the main shaft, the steps of the hammers will be enlarged or shortened all to the same degree. And rings may be used as compacting elements in lieu of the elongated hammers.

6 Claims, 14 Drawing Figures

SOIL COMPACTING MACHINE

This invention relates generally to a machine for compacting or densifying the soil surface, and more particularly to such a machine as having a plurality of vertically reciprocating compacting elements capable of falling successively into engagement with the soil surface and pausing during such engagement until they are successively again moved upwardly.

Traditionally, rollers of some type are used for compacting or densifying the ground surface in the construction of roads and the like. Such rollers may include those having spikes or those in the form of pneumatic tires loaded in some manner with weights. Also, means may be provided for effecting a vibration of the roller during the compacting operation. In all such cases, however, the roller is loaded with a static weight to achieve the best possible results. Accordingly, the compacting machines of the roller type have reached such size and weight as to render them uneconomical and relatively ineffective in their widespread use and too costly for transport to and from the construction site. Moreover, none of these existing roller machines used for compacting ground surfaces are effective in the construction of steep inclines for dams and the like.

Tampers are also known for their use for light tamping or compacting operations by means of a series of cam operated tamping bars or shoes. These tampers are most useful in the formation of concrete or asphalt pavements and the like. For larger jobs such as the formation of road beds or highways wherein sometimes rock and gravel beds must be contended with, these light compacters are of little use especially since they are capable of only creating a short-stroke vibratory motion. Also, because of their relatively high vibrational speeds and their light mass, these tampers bounce back from the surface during contact in a quick and snapping blow to therefore compact the surface to some degree at the instant of such contact as the air entrapped therein is compressed. But, since the tamper moves away therefrom practically immediately, the compressed air causes a disruption of the ground surface. This is highly undesirable if the tamper must compact the soil surface for the laying of a roadbed, and the like.

The essential constituents for good ground compaction are compression, expelling of the air during compression, soil crystal orientation and a sealing off of the compacted soil so that the air does not immediately re-enter. Additionally, the kneading of the soil contributes greatly to the orientation of its crystals. It is an object of the present invention to effect a de-airing of the soil during compression thereof by the dead weight of sequentially falling hammers. Each of the hammers pauses for a short time after it hits the ground and before it is lifted up again. The pause is sufficient to permit the compressed air to escape beneath the hammer without lifting up the soil as the hammer subsequently leaves the ground. Densification of the soil occurs also through an orientation of the soil crystals, such orientation serving even more to cause the air to be expelled through a reduction of the space between the crystals. Such orientation takes place without relying on vibrational forces as in the past.

Another object is to provide such a machine wherein each of the hammers is provided with a circular or oval opening at one end through which a main rotary shaft extends, arm members being mounted along the shaft for rotation therewith, with an arm member being associated with each hammer and with each arm member being mounted eccentrically with respect to the hammer openings at different radial positions along the shaft. Accordingly, the hammers are moved successively upwardly as the arm members each rotate between an approximately forward and backward horizontal position and an upward vertical position, the hammers being permitted to be moved successively downwardly into contact with the soil as the arm members rotate beyond their approximately rearward or forward horizontal positions. Each of the hammers remain in contact with the soil during rotation of its respective arm member between the approximately rearward or forward and the approximately forward or rearward horizontal positions thereof, thereby permitting the air in the soil to escape beneath the hammer and the crystals to orientate. Also, rollers are provided in engagement with the side edges of the hammers for regulating and limiting their shifting movement.

Another object of this invention is to provide a machine as characterized above wherein the limiting rollers are mounted for movement toward and away from the main shaft to permit the degree of shift of the hammers to be varied along the shaft to thereby effect a turning movement for the machine.

A further object is to provide a machine for compacting soil wherein circular discs are used as the hammers which may have spiked ground-engaging surfaces, and means being provided for steering such machine.

Other objects, advantages and novel features of the invention will become more apparent from the following detailed description of the invention when taken in conjunction with the accompanying drawings wherein.

Figure 1:
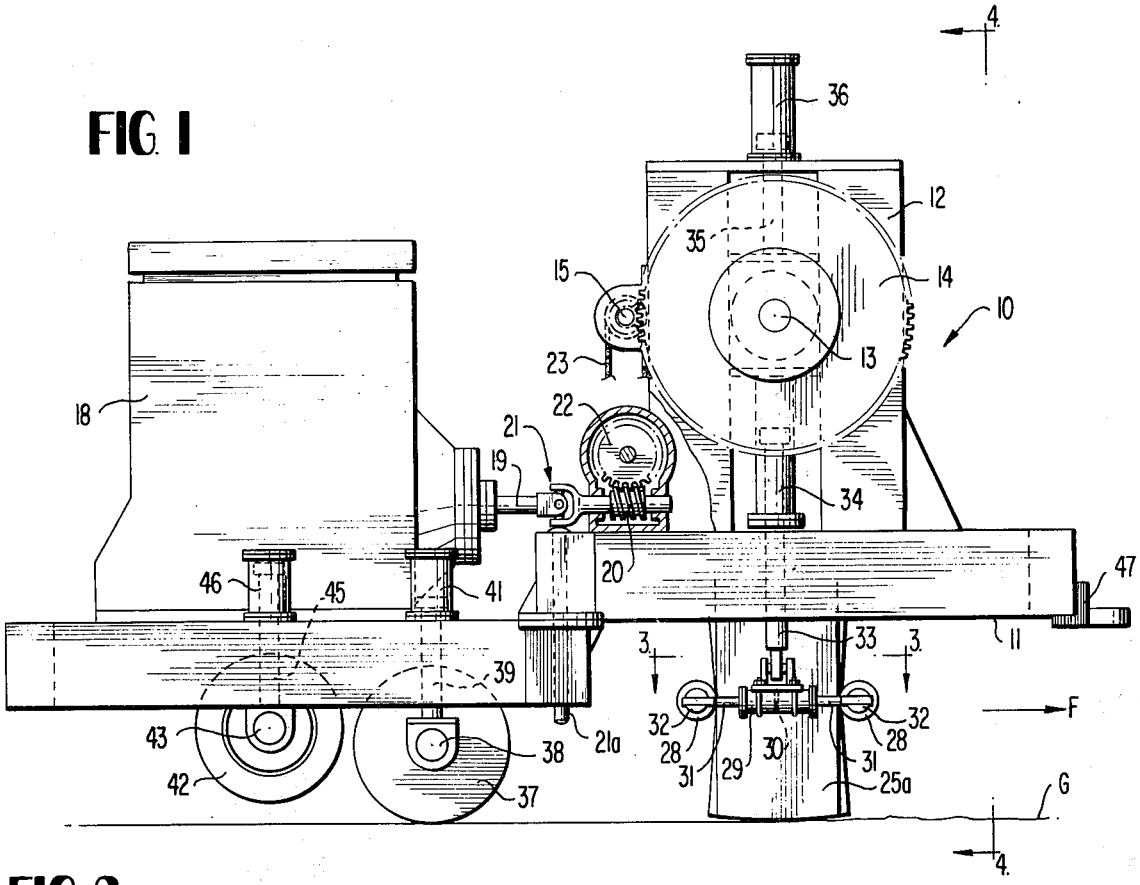
FIG. 1 is a side elevational view of the machine in accordance with the invention.
Figure 2:
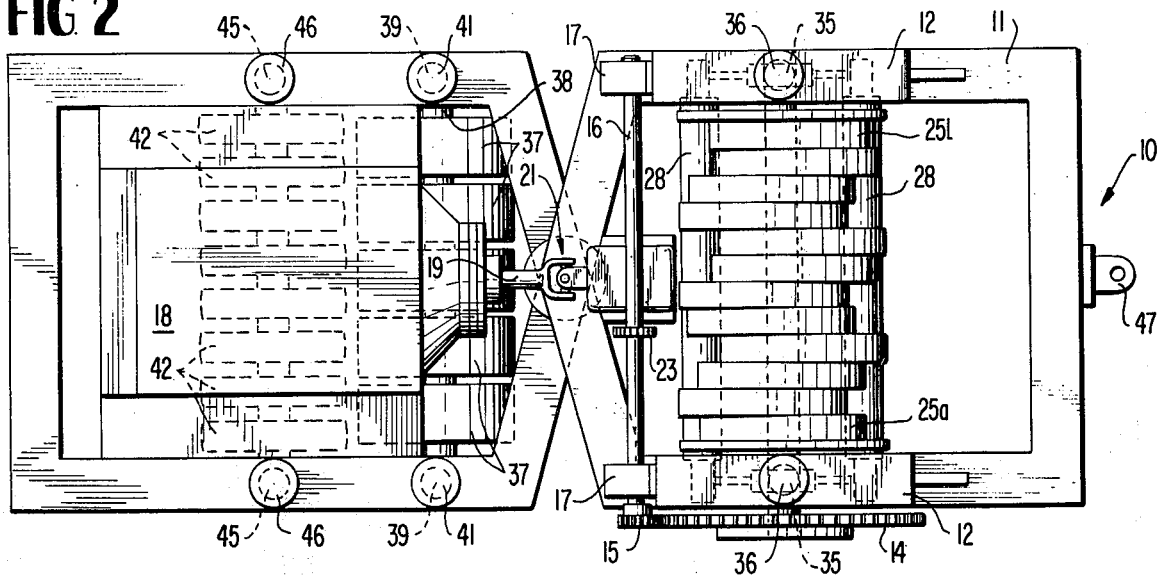
FIG. 2 is a top view of the machine of FIG. 1.

Turning now to the drawings wherein like reference characters refer to like and corresponding parts throughout the several views, the overall machine 10 is shown in FIGS. 1 and 2 as generally an articulated frame member 11 having at one end upstanding side plates 12 mounted thereon between which a main rotary shaft 13 is journalled. The shaft has a gear wheel 14 at one or both ends in interengagement with the teeth of a gear wheel 15 mounted on a shaft 16 journalled between bearing plates 17 mounted on plates 12.

A power unit 18 is mounted on the other end of the frame, and its power drive rod 19 is coupled with a worm 20 through a universal coupling 21. Sections of the frame are pivotally interconnected by means of a pivot pin 21*a*. The worm is interengaged with a worm gear 22 so that, upon rotation, gear 15 is turned via gear chain 23 for rotation of main rotary shaft 18.

Figure 3:
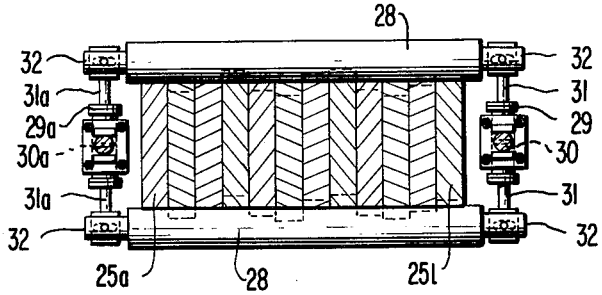
FIG. 3 is a sectional view of the plurality of hammers and their limiting rollers taken along the line 3—3 of FIG. 1.
Figure 7:
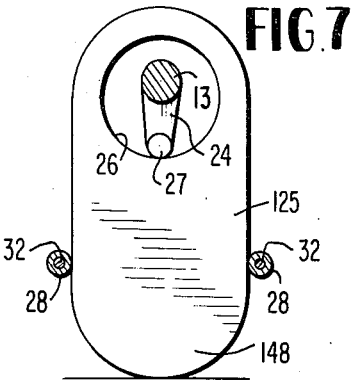
FIGS. 7 and 8 are side elevational views of two different embodiments of the hammer.
Figure 8:
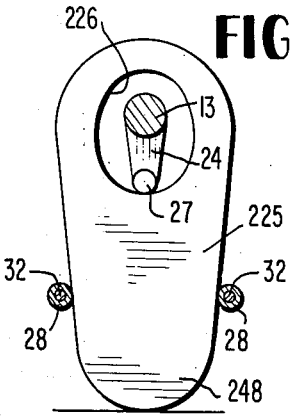

Arm members 24 (see FIG. 5) are keyed to the main rotary shaft for rotation therewith. An arm member is associated with each of a plurality of hammers or compacting elements 25*a* through 25*l*. Each of these hammers has an opening 26 at one end which, for the embodiments of FIGS. 5 and 7, is circular, and for the embodiment of FIG. 8 is oval as at 226. The main rotary shaft 13 extends through the openings of each of these hammers 25*a* through 25*l*, and arm members 24 each have free wheeling rollers 27 thereon in rolling contact with the wall of opening 26 for each of its respective hammers. The hammers are each mounted on shaft 13 eccentrically in relation to their respective hammer openings and are each mounted at different radial positions along the shaft in a manner shown, for example, in FIG. 6 wherein letters *a* through *l* designated orientation of the various arm members 24 associated with each of the hammers 25*a* through 25*l*. Elongated hollow limiting rollers 28 (see FIG. 3) extend along opposite side edges of the plurality of hammers between hydraulic dashpot cylinders 29, 29*a*. A rod 32 is disposed within each roller and extends outwardly of both ends thereof. Each cylinder 29 and 29*a* has a partition wall 30, 30*a* separating the cylinder into two sections. Piston rods 31 extend outwardly of each section of cylinder 29, and piston rods 31*a* extend outwardly of each section of cylinder 29*a* as shown in FIG. 3. Opposite ends of each rod 32 are secured to piston rods 31 and 31*a*, respectively. Also, each cylinder 29 and 29*a* is connected to the respective free ends of piston rods 33 (see FIG. 1).

Each rod 33 extends through frame member 11 and is disposed at its upper end within a conventional hydraulic cylinder 34. Each cylinder is connected with a hydraulic fluid line (not shown) for effecting independent movement of rods 33 in and out of their respective cylinders.

The journalled ends of the main rotary shaft 13 are connected to piston rods 35 which extend outwardly of their respective cylinders 36 each mounted on side plates 12. Each cylinder 36 is operatively interconnected with hydraulic means (not shown) for effecting parallel movement of the main rotary shaft toward and away from the frame member 11.

At least two spaced hammers 25 will be in contact with the ground G surface during operation of the machine in a manner to be hereinafter described. In order to stabilize the balance of the machine during such operation, ground engaging wheels 37 are mounted for free rotation of shaft 38 journalled in suitable bearings and extending downwardly from frame member 11 as seen in FIG. 1. Piston rods 39 are interconnected with the journalled bearings at opposite ends of shaft 38 and extend upwardly through frame member 11 and into their respective hydraulic cylinders 41. Each of these cylinders is interconnected with hydraulic means (not shown) for effecting parallel movement of wheels 37 toward and away from the frame member.

Since movement of the machine is effected by a walking action upon rotation of the main rotary shaft to be explained in detail hereinafter, transportation of the machine to and from the job site is made possible through the use of wheel means such as pneumatic tires 42 mounted on shaft 43 and interconnected at their journalled bearing ends with piston rods 45 of hydraulic cylinder 46. Transportation tires 42 may therefore be lowered with respect to the frame member during transport of the apparatus except that they are elevated from the ground during the compacting operation. Also, a hitch 47 is secured at one end of the machine for hitching it to a tractor during transportation to and from the job site.

Upon rotation of main rotary shaft 13, each of the arm members 24 is rotated in the direction of their arrows shown in FIG. 5, for a forward movement of the machine, from its particular starting position so that its respective hammer 25 may be raised upwardly away from the ground and allowed to drop in the manner to be now described. For those arm members directed vertically downwardly as shown in FIG. 5A, hammers 25*a* and 25*l* will be substantially in contact with the ground at their ground contacting surfaces 48*a* and 48*l*. Rotation of the arm member is a counterclockwise direction when viewed in FIG. 5, causes movement of its roller 27 along its downward vertical position and its forward horizontal position (arrow F) of FIG. 5B, hammer 25 is slightly shifted so as to slope in a forward direction with the slope of its forward shift being defined by the elevation of bars 28. Bars 28 remain in contact with opposite side edges of each hammer by reason of the dashpots.

Figure 5A:
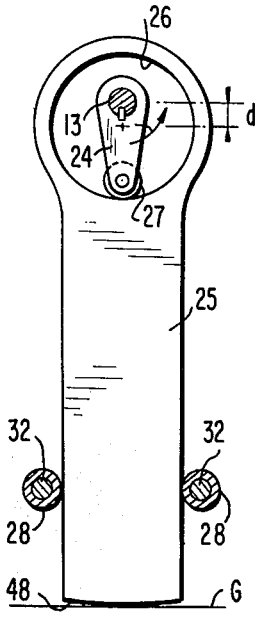
FIGS. 5A to 5D are each side elevational views of a hammer illustrating the various sequences during the lifting and falling movements of each hammer as its eccentric arm member rotates.
Figure 5B:
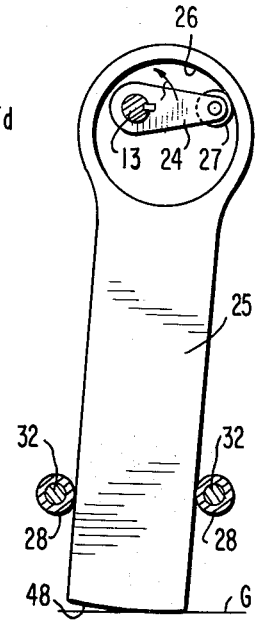
Figure 5C:
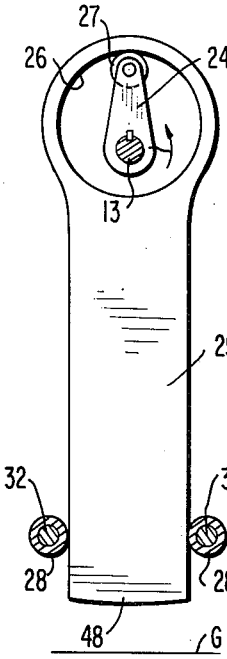
Figure 5D:
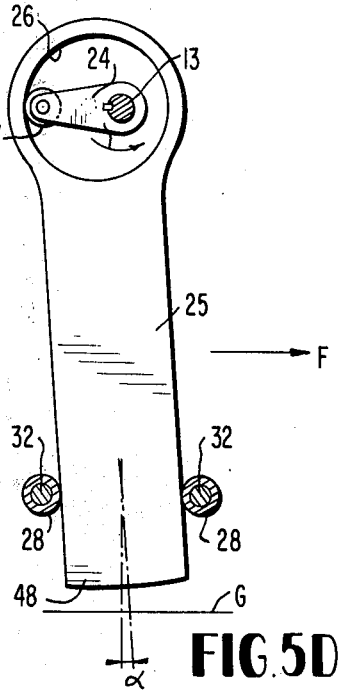
Figure 6:
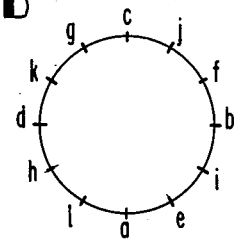
FIG. 6 is a diagrammatic illustration of the relative radial position of each of the arm members mounted on the shaft for each of the hammers.

Continued rotation of arm member 24 from its substantially forward horizontal position to its upward vertical position shown in FIG. 5C, causes the hammer to be lifted upwardly away from the ground as guided by bars 28. Further rotation of the arm member from its upward vertical position to its substantially rearward horizontal position of 5D, causes the hammer to slightly lower and to be shifted into a slightly rearwardly sloping position using bars 28 as fulcrums. Continued rotation of the arm member beyond this substantially rearward horizontal position and until it again reaches its downward vertical position of FIG. 5A, permits the hammer 25 to drop under its own weight, and possibly assisted by the arm member, into contact with the ground at substantially an angle $\alpha$ to the vertical shown in FIG. 5D. From the time arm member 24 continues its rotation beyond its rearward horizontal position of FIG. 5D and until it reaches its forward horizontal position of FIG. 5B, surface 48 of the hammer is in contact with the ground surface as it rocks between its position of 5D and that of 5B on this slightly curved ground contacting surface 48. This dwell period and rocking action of the hammer and the falling of the hammers side by side effects a kneading action against the soil surface.

As at least two of the hammers among the 12 shown in the drawings are in the process of contacting the ground surface during this dwell period, two or more other hammers are in the process of being lowered or raised so that a sequential dropping action of the hammers is effected as shaft 13 rotates. The radial positions of the various arm members may vary from that shown in FIG. 6 so long as a balance of the hammers is assured across the machine. Also, fewer or more than the number of hammers shown may be provided.

Figure 4:
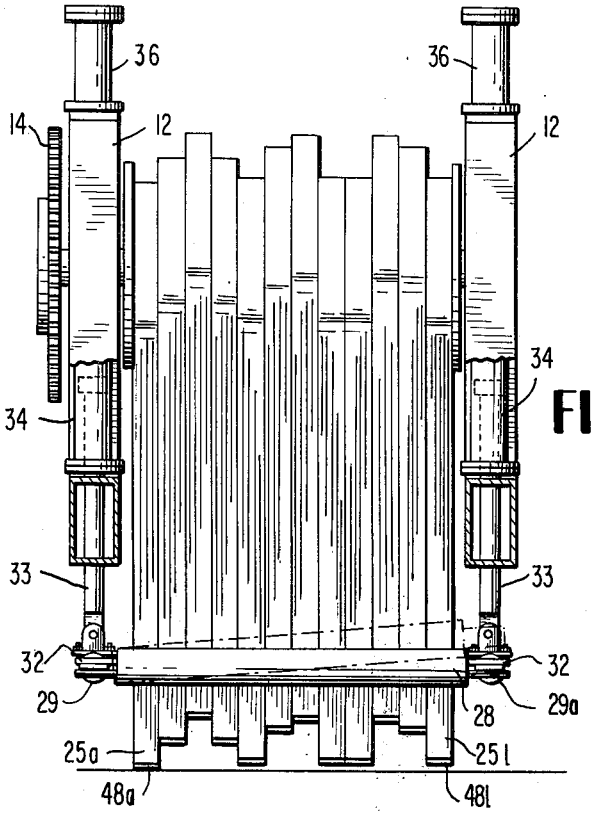
FIG. 4 is a view taken along the line 4—4 of FIG. 1 showing an end elevation of the plurality of hammers.

As the hammers sequentially fall into contact with the ground surface, the soil is compacted and densified by expelling the air and orienting the soil crystals as the soil is subjected to pressure during the dwell period of each hammer in its rocking action thereagainst. During this dwell period, the air trapped in the soil is given sufficient time to escape and sufficient time is permitted for orientation of the soil crystals. Moreover, rotation of main rotary shaft 13 in either direction alone effects movement of the machine in both a forward and a reverse direction without any additional moving means. The rocking movement of each of the hammers between the time it falls and the time it is raised upwardly away from the ground surface is in the nature of a walking action to thereby propel the machine. Moreover, steering means are not required for this machine to effect turning since one end or the other of interconnected rollers 28 may be raised or lowered by their piston rods 33, as in the manner shown in phantom outline in FIG. 4. Accordingly, the fulcrum points on limiting rollers 28 gradually change between hammers 25*a* through 25 *l* to thereby vary the slope thereof in a straight line ratio between hammers 25*a* and 25*l*. The machine will therefore be turned in the direction opposite the higher positioned end of roller bars 28 much the same as the turning of a column of marching soldiers. Also, piston rods 31 and 31*a* move inwardly and outwardly in the manner of conventional dashpots for increasing the distance between rollers 28, as when the rollers are raised for turning. Moreover, it may be necessary to adjust the ground-contact positions of the hammers for steep inclines during forward and reverse movement of the apparatus.

In the embodiments shown in FIGS. 7 and 8, hammer 125 is more sharply rounded at its ground contacting surface 148 as compared to surface 48 shown in the FIG. 5 embodiment. Also, hammer 225 of FIG. 8 is provided with a vertically oval opening 226 and has sloped side edges as compared to the FIG. 7 embodiment. The rounded contact surface 248 is similar to that of 148 to effect a smoother shifting action of each hammer, depending on its size, weight and speed of revolution of its arm member. Also, opening 226 of hammer 225 effects a greater slope thereof during its forward and rearward shift and causes hammer 225 to be lifted only as the arm member moves between a forward or rearward and upward 45° position and a rearward or forward and upward 45° position. The dwell period for the hammer while approaching the ground surface and in contact therewith is therefore slightly greater as compared to that of the FIG. 7 embodiment.

Figure 9:
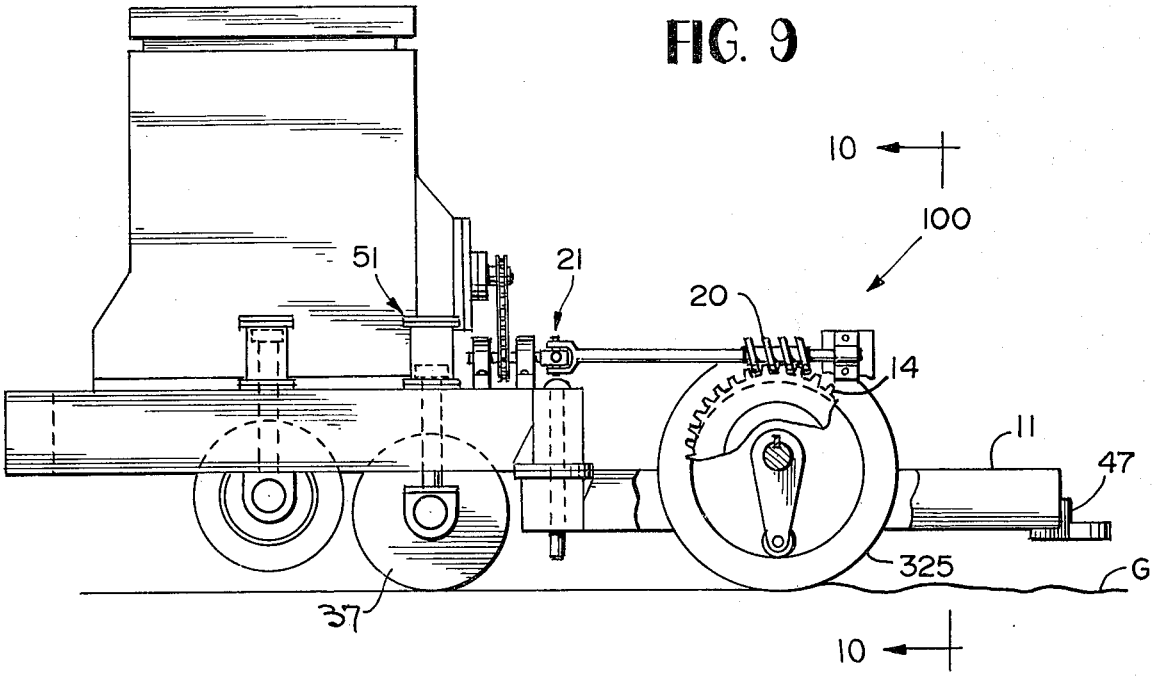
FIG. 9 is a side elevational view similar to FIG. 1 showing part of another embodiment of the machine.
Figure 10:
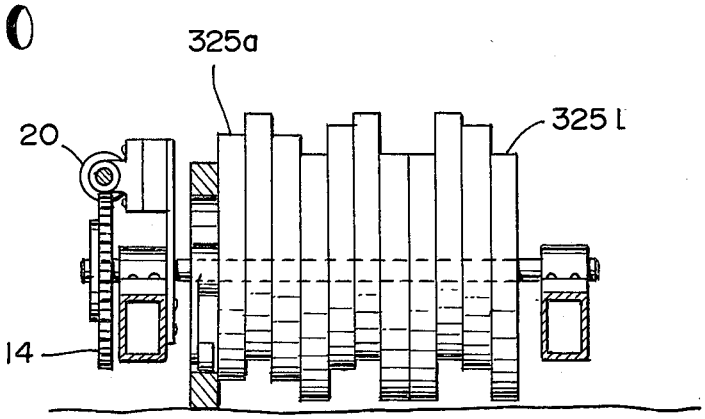
FIG. 10 is a front elevational view of the FIG. 9 machine.
Figure 11:
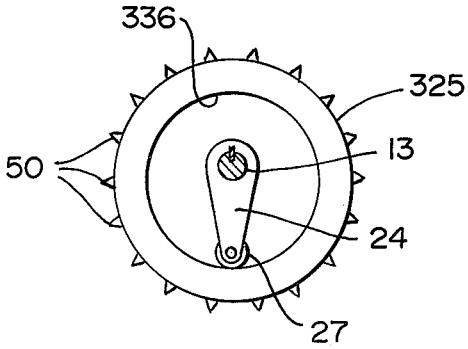
FIG. 11 is a side elevational view of another embodiment of the hammer.

Machine 100 shown in FIG. 9 is similar in many respects to the machine of FIG. 1 except that circular compacting elements or rings 325 are used in lieu of elongated hammers 25. These rings are raised and elevated similarly as hammers 25 as arm members 24 arranged on rotary shaft 13 are rotated in the manner as described hereinabove. The shaft has a gear wheel 14 thereon and is rotated by means of worm wheel 20 in engagement therewith. Each of the rings 325*a* through 325*l* are eccentrically arranged relative to shaft 13 and rollers 27 of arms 24 are in rolling contact with the wall of circular openings 336 thereof. Ground-engaging surfaces 325 of the rings therefore are made to sequentially contact ground surface G during shaft rotation. Spikes 50 or the like may be provided on these surfaces 325 to avoid slippage with the ground surface for steep inclines. Also, since limiting rollers are not provided for this embodiment, conventional steering means shown generally at 51 are provided for steering wheels 37 so as to effectively guide the machine.

From the foregoing, it can be seen that a simple yet highly effective and uniquely operating soil compacting machine has been devised which effects a dwell period for each of a series of hammer sequentially falling to the ground for compacting the soil and insuring an improved degree of compaction by permitting the air within the soil to escape beneath each of the hammers. Good densification of the soil is also permitted by reason of an orientation of the crystals during the kneading action effected by each of the hammers and among them on the soil so as to permit the entrapped air in the soil to escape with less likelihood of an explosive action as in those prior art devices making use of short and snapping damper strokes. Depending on the type of soil and the surface area to be compacted, the curvature of ground contacting surfaces 48 of the hammers may vary along with the hammer weight and size. Also, the extent of the drop for the hammers may vary, depending on the relative size and shape of opening 26 and the size of arm member 24, along with the speed of rotation of shaft 13. The drop of each of the hammers may be accelerated by their respective arm members depending on the speed of shaft 13 rotation. Also, the step of the hammers may be enlarged or shortened by raising or lowering the limiting bars, parallel to the main shaft. Moreover, wheels are not required for supporting the hammers during its compacting operation since the hammers such as 25*a* and 25*l* are in contact with the ground and are supported by means of their downwardly vertically positioned arm members 24. Wheels 37 are merely required for balancing the machine during its compacting operation although, if another set of hammers, arm members and rotary shaft were provided in a similar manner as above described, wheels 37 could also be eliminated. Furthermore, no steering mechanism is required for the FIG. 1 machine since it may be turned simply by adjusting the fulcrum points of the hammers as bars 38 are raised or lowered at one end thereof. The walking action provided by the particular arrangement as set forth above avoids the need for any auxiliary power in moving the machine during the operation of compacting. Rotation of main rotary shaft 13 itself will produce not only the necessary compacting action but will also serve to move the machine in its forward or backward direction as the rotary shaft is rotated in a counterclockwise direction when moving forward when viewing FIG. 1.

Moreover, circular discs may be used as compacting elements with spikes thereon if desired to facilitate the climbing of steep inclines.

Obviously, many other modifications and variations of the present invention are made possible in the light of the above teachings. It is therefore to be understood that within the scope of the appended claims, the invention may be practiced otherwise than as specifically described.

What is claimed is:

1. A soil compacting machine comprising frame means with a rotary shaft mounted thereon, a plurality of hammers serving as compacting elements, each of said hammers having a curved opening through which said shaft extends, each said hammer having a ground-engaging surface, ground-engaging means on said frame means for stabilizing the machine during its soil compacting operation, arm members mounted along said shaft for rotation therewith, one of said arm members being associated with each of said hammers and each being mounted eccentrically with respect to said hammer openings at different radial positions along said shaft, means for rotating said shaft to effect a walking movement of the machine in forward and reverse directions whereby, upon said rotation, said hammers are caused to be moved successively upwardly as said arm members each rotate between an approximately forward or rearward horizontal position and an upward vertical position, and whereby said hammers are permitted to be moved successively downwardly into contact with the soil as said arm members rotate beyond their approximately rearward or forward horizontal positions, each said hammer remaining in contact with the soil at said opposite end thereof during rotation of its respective arm member between the approximately rearward or forward and the approximately forward or rearward horizontal positions thereof, whereby said hammers effect a kneading action against the soil to thereby expel the air therefrom and effect an orientation of the soil crystals for improving upon the compaction of the soil surface.

2. The machine according to claim 1, wherein said hammers are elongated and limiting rollers are provided on said frame at opposite side edges of said hammers, means being provided for mounting at least one end of said limiting rollers to said frame means for movement toward and away from said shaft so that, by varying the distance of said one end with respect to said shaft, the slope and therewith the length of the step of said hammers may be varied from one end of said limiting roller means to the other, to thereby effect a turning movement for the machine, and parallel movement of said limiting roller means toward and away from said shaft serves to vary the length of the step of said hammers.

3. The machine according to claim 1, wherein said ground-engaging means comprise rollers mounted on said frame means for movement toward and away therefrom.

4. The machine according to claim 1, wherein said ground engaging surfaces on said hammers are curved in a forward and rearward direction.

5. The machine according to claim 1, wherein said hammers are circular, and steering means being interconnected with said ground-engaging means for steering the machine.

6. The machine according to claim 5, wherein spikes are provided on said ground-engaging surfaces of said circular hammers for avoiding slippage with the ground surface especially for steep inclines.

* * * * *